United States Patent [19]

Hsien-Yang

[11] Patent Number: 4,681,554

[45] Date of Patent: Jul. 21, 1987

[54] TOY DEVICE WHICH CAN BE OPENED AND POSITIONED AT ANY DESIRED ANGLE

[76] Inventor: Chang Hsien-Yang, Fl. 2, No. 2-2, Lane 762, Ding Chou Rd., Taipei, Taiwan

[21] Appl. No.: 814,380

[22] Filed: Dec. 30, 1985

[51] Int. Cl.[4] ..... A63H 27/20; A63H 31/02

[52] U.S. Cl. ..... 446/231; 446/470; 446/487; 74/103

[58] Field of Search ..... 446/230, 231, 487, 470, 446/428; 294/115, 50.8; 74/103, 102, 96

[56] References Cited

U.S. PATENT DOCUMENTS

| | | | |
|---|---|---|---|
| 294,147 | 2/1884 | Poole | 294/115 X |
| 1,523,063 | 1/1925 | Fuchs | 294/115 X |
| 4,044,974 | 8/1977 | Lingley et al. | 244/137 R X |
| 4,294,032 | 10/1981 | Breneman | 446/231 |
| 4,477,999 | 10/1984 | Harigai et al. | 446/470 |

*Primary Examiner*—Robert A. Hafer
*Assistant Examiner*—Terrence L. B. Brown

[57] ABSTRACT

A toy device is disclosed which can be opened at any angle desired by means of a mechanical structure, which comprises mainly a fixed member with two notches being furnished at both ends respectively; two movable members, of which the bottom ends are fixed respectively to two transmission members being mounted in the notches on the fixed member; a control member, of which two lugs on both ends thereof are hooked in the two round holes of the two transmission members respectively so as to have the control member coupled with the two movable members. When the control member is being driven to move upwards, the movable members will be moved to open at a given angle or fully open at an angle of 180°.

2 Claims, 4 Drawing Figures

TOY DEVICE WHICH CAN BE OPENED AND POSITIONED AT ANY DESIRED ANGLE

BACKGROUND OF THE INVENTION

In conventional toys, the door of a toy car, the top door of a toy space shuttle, or the mouth of a toy animal, can only be opened with limitations as to angular displacement, or time; i.e., must generally be fully opened or closed within a few seconds in one cycle. This feature will render a toy monotonous to a user, as presenting little or no variety in the opening angle at which it may be positioned, if so desired. As a result, the user, for example a baby, will soon lose interest in the toy, since the toy is considered not an ideal toy.

SUMMARY OF THE INVENTION

The inventor has developed this invention in order to improve the disadvantages of conventional toys. The prime feature of the present invention is that each of the both ends of a fixed member is furnished with a notch for receiving a transmission member therein; each of the transmission member is fixedly mounted with a movable member. A control member has two lugs at both ends for hooking into two round holes respectively on the transmission member; then, the control member can be coupled with the movable members. Upon the control member being driven upwards to actuate the transmission members to move upwards along the notches respectively and until the notches of the transmission members touching the inner edges of the notches of the fixed member, the movable members will be opened as a result of the transmission members slantingly extending outwards. The movable members can be opened at various angles in accordance with the length of the notches thereof. Upon the end of the transmission members being retained in the notches of the fixed member respectively, the movable members will fully be opened at an angle of 180°.The movable members can be opened and positioned at a given angle desired by controlling the elevating of the control member for a greater variety in terms of the opening extent.

It is another feature of the present invention that each of the two movable members is formed into a semicircular shape, and the two of them can form a circle. The two semicircular halves can be opened and closed synchronously.

It also is another feature of the present invention that the transmission members and the movable members are connected together; and the opening angle of the movable members, the slanting angle of the transmission members and the length of notches on the transmission members are closely related one another. When the transmission members are being elevated to such an extent that the respective notch of a transmission member has been in contact with the inner edge of the notch on the fixed member, the movable member will be opened outwards as a result of the slanting position of the transmission member, i.e., the greater the slanting angle of a transmission member is, the greater will be the opening angle of the movable member.

DETAILED DESCRIPTION

Figure 1:
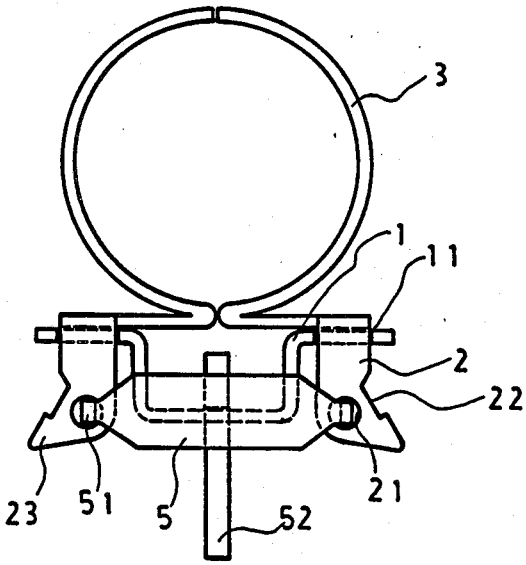
FIG. 1 is an elevational view of a toy according the present invention after assembly.

Referring to FIG. 1, there is shown an elevational view of the present invention, in which both ends of a fixed member 1 are respectively furnished with notches 11 for mounting a transmission member 2 in each. The transmission members 2 are furnished with a round hole 21 and a notch 22 on one of its edges. The top end of each transmission member 2 is connected to a respective semicircular movable member 3. A control member 5 has a lug 51 on each of its two ends for engaging in the round hole 21, whereupon the control member 5, the transmission members 2 and the movable members 3 are connected together. In the center of the bottom of the control member 5, there is furnished a guide plate 52 (or a screw rod), which can be driven upwards so as to drive the transmission members 2 to move upwards.

Figure 2:
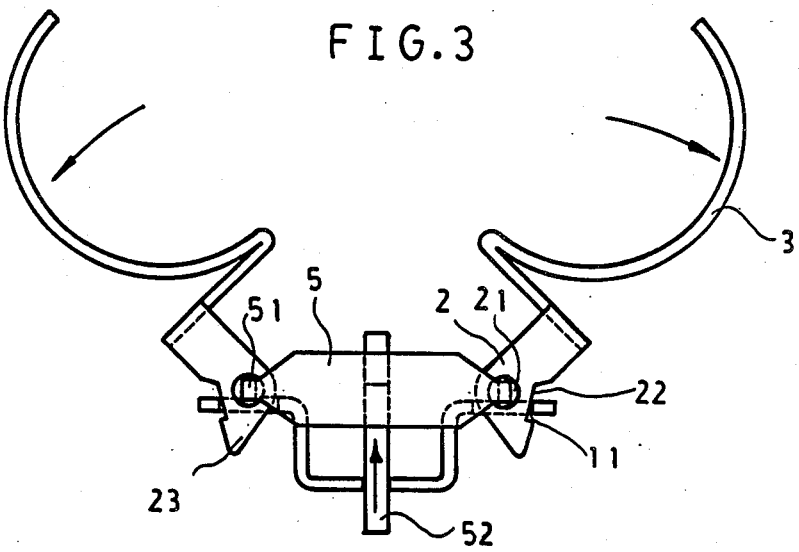
FIG. 2 illustrates the toy of FIG. 1 having been opened at a given angle.

Referring to FIG. 2, there is shown a toy according to the present invention which has been opened at a given angle, i.e., upon the guide plate 52 being driven upwards, the transmission members 2 will, along the notch 11, be moved upwards. When a notch 22 is in contact with the inner edge of the notch 11, the respective transmission member 2 will move slantingly outwards to cause the two movable members 3 to be opened at a given angle, i.e., at a desired angle.

Figure 3:
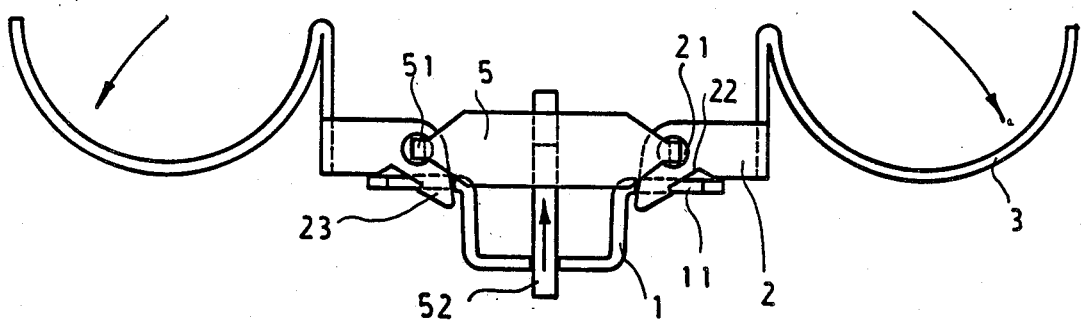
FIG. 3 illustrates the toy of FIG. 1 in fully opened position.

In FIG. 3 are shown the two movable members 3 being fully opened at an angle of 180°. When the pointed ends 23 of the transmission members 2 have been raised and enganged in the notches 11, respectively to the limit therein; likewise, the movable members 3 may also be opened at a desired given angle by fixing the guide plate 52 therein.

Figure 4:
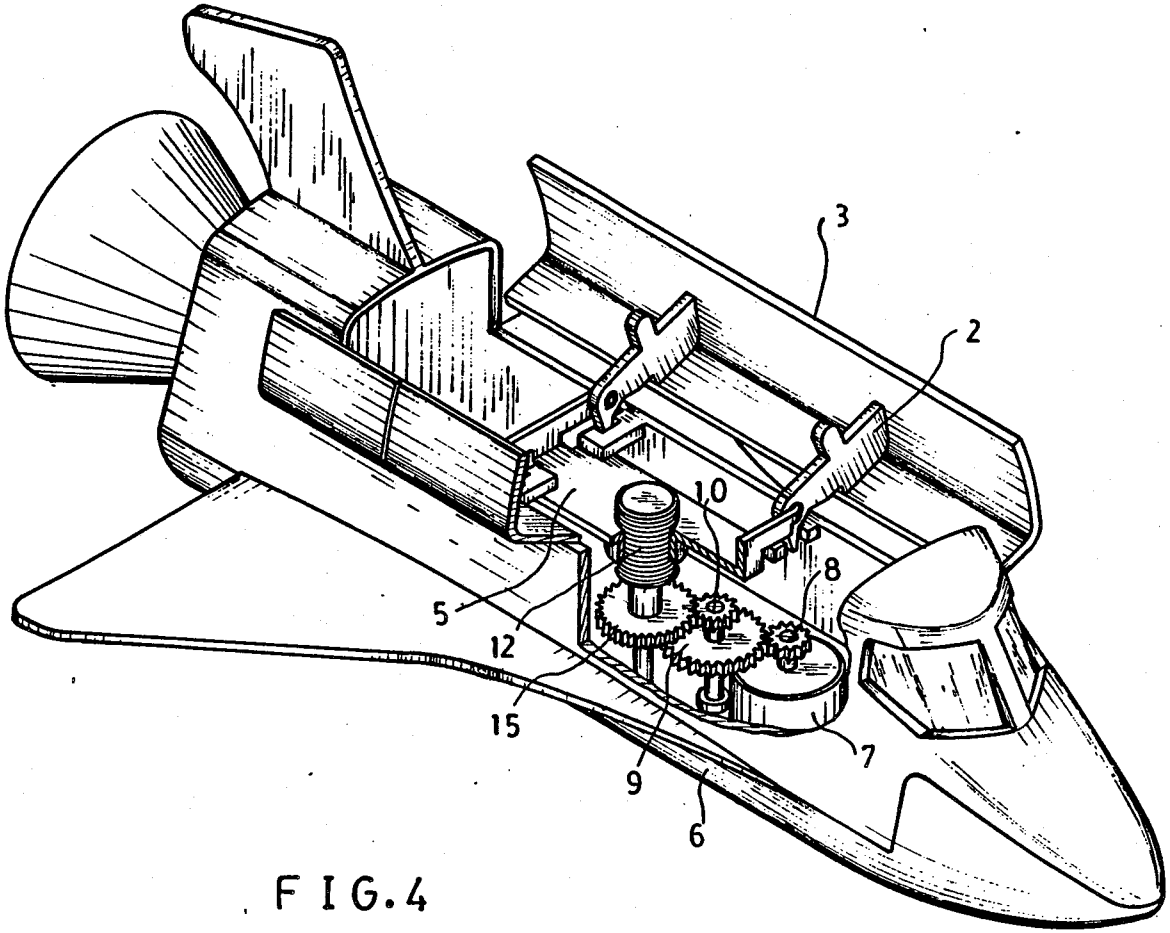
FIG. 4 is a perspective view of the toy according to the present invention.

In FIG. 4 is shown an embodiment of the present invention in which a toy space shuttle 6 is equipped for controlling the opening and closing of the top of the toy space shuttle 6. In this embodiment, a small motor 7 is used for driving a pinion 8 engaging a gear 9 and, indirectly, for driving a pinion 10, through which a gear 15 is driven to actuate a screw rod 12, thereby to cause the control member 5 engaged by the rod 12 to move upwards. The control member 5 will actuate the transmission members 2 to slant outwards, and then the movable members 3 will be opened outwards. The higher the control member 5 is moved upwards, the wider the movable members 3 will be opened. The movable members 3 may be opened at any angle desired by stopping the rotation of the small motor 7 at that desired angle. In the aforesaid embodiment, the screw rod 12 may be replaced by a guide plate 52. Further, the control member 5, the transmission members 2, and the movable members 3 are assembled in the same manner as shown in FIG. 1, but the shapes thereof may be modified so as to adapt to various kinds of toys. Therefore, the aforesaid embodiment is merely used as an example to describe the present invention, but it is by no means to limit the present invention. The present invention may be modified and changed by a person skilled in the art without deviating from the spirit of the present invention, and in that case, it should be considered within the scope of this invention claimed.

I claim:

1. A toy device able to be opened and positioned at any angle desired comprising:

a fixed member having two ends, of which the both ends are furnished with notches to receive a transmission member in each of said notches;

transmission members, each of which is mounted in a respective one of said notches in a vertically movable manner, each of said transmission members is also furnished with a round hole, and also furnished at one side with a notch, and each of said transmission members has a pointed end in a lower portion;

two movable members, each of which is formed into a semicircular shape, and being fixedly connected with a top portion of a respective one of said transmission members; and the slanting movement of said transmission members can control said movable members to open outwards;

an actuation means, said actuation means comprising a guide plate;

a control member having two ends, of which the both ends are furnished with lugs respectively for hooking into the round holes of said transmission members respectively so as to connect together with said transmission members; and in the center bottom of said control member, there is mounted a guide plate which is able to be driven to move up and down so as to actuate said transmission members to move up and down simultaneously; and upon said guide plate being driven to move upwards said control member actuates said transmission members to move upwards; said transmission members move upwards until said notch on respective ones of said transmission member is engaged with said notch on said fixed member, and then said transmission members slantingly move outwards and actuate simultaneously said movable member to open at an angle; and said movable member will fully be opened at an angle of 180° with respect to the other one of said movable members; wherein said movable member will be fully open upon a respective lower edge of said notches of said transmission members being retained by the edge of the notch on said fixed member; and said movable member may be positioned at a given angle desired by controlling said guide plate at a position corresponding to the angle desired.

2. A toy device able to be opened and positioned at any angle desired as claimed in claim 1, wherein said actuation means on said control member is a screw rod.

* * * * *